US007306494B2

(12) United States Patent
Soh

(10) Patent No.: US 7,306,494 B2
(45) Date of Patent: Dec. 11, 2007

(54) CONNECTOR

(75) Inventor: Lip Teck Soh, Singapore (SG)

(73) Assignee: FCI, Versailles (FR)

( * ) Notice: Subject to any disclaimer, the term of this patent is extended or adjusted under 35 U.S.C. 154(b) by 0 days.

(21) Appl. No.: 10/566,865

(22) PCT Filed: Jul. 30, 2004

(86) PCT No.: PCT/SG2004/000231

§ 371 (c)(1),
(2), (4) Date: Jan. 31, 2006

(87) PCT Pub. No.: WO2005/013430

PCT Pub. Date: Feb. 10, 2005

(65) Prior Publication Data

US 2006/0252287 A1 Nov. 9, 2006

(30) Foreign Application Priority Data

Aug. 1, 2003 (SG) ..... 200304106-8

(51) Int. Cl.
*H01R 4/18* (2006.01)

(52) U.S. Cl. ..... 439/862

(58) Field of Classification Search ..... 439/862, 439/83, 66

See application file for complete search history.

(56) References Cited

U.S. PATENT DOCUMENTS 4,268,102 A * 5/1981 Grabbe ..... 439/331
4,761,140 A * 8/1988 Geib ..... 439/71
5,460,546 A 10/1995 Kunishi et al. ..... 439/631
5,882,212 A 3/1999 McHugh et al. ..... 439/74
6,203,331 B1 3/2001 McHugh et al. ..... 439/71
6,672,879 B2 * 1/2004 Neidich et al. ..... 439/67
6,811,406 B2 * 11/2004 Grube ..... 439/66
6,814,587 B2 * 11/2004 Ma ..... 439/66
6,888,362 B2 * 5/2005 Eldridge et al. ..... 324/757
6,994,565 B2 * 2/2006 Harper, Jr. ..... 439/66
7,156,705 B2 * 1/2007 Soh ..... 439/862
2005/0176309 A1 * 8/2005 Soh ..... 439/862

FOREIGN PATENT DOCUMENTS

| | | |
|---|---|---|
| EP | 0 280 450 B1 | 8/1988 |
| JP | 09-027367 | 1/1997 |
| JP | 2000-150044 | 5/2000 |
| WO | WO 97/02631 | 1/1997 |
| WO | WO 03/049517 A1 | 6/2003 |
| WO | WO03/049517 * | 12/2003 |

* cited by examiner

*Primary Examiner*—Tulsidas C. Patel
*Assistant Examiner*—Phuongchi Nguyen
(74) *Attorney, Agent, or Firm*—Harrington & Smith, PC

(57) ABSTRACT

A connector for electrically connecting two electrical points, the connector having one or more connector terminals arranged in a connector housing, the connector terminal includes a resilient arm portion which bends or deflects about a first pivot portion when the connector terminal is compressed initially and resilient arm portion bends or deflects about a second pivot point when the connector terminal is further compressed subsequently.

41 Claims, 11 Drawing Sheets

500

500

CONNECTOR

FIELD OF THE INVENTION

The invention relates to connectors for electrically connecting at least two electrical points and more particularly, to connectors for electrically connecting printed circuit boards (PCBs).

BACKGROUND

There are various known types of connectors available for electrically connecting one PCB to another PCB or circuit, for example a flex circuit. Two circuit boards may be electrically connected to each other by connecting formed electrical contact areas on one circuit board to corresponding contact areas on another circuit board through a connector. In most cases, the contact areas are in the form of contact pads. The connectors allow transmission of electrical signals from one circuit board to the other.

A conventional connector comprises one or more spring-like terminals arranged within a connector body or housing. Connectors engage a circuit board in a variety of ways. One way uses "compression terminals", where the electrical contact area is a pad on the PCB and the terminals are adapted to be resiliently compressed when pressed against the pad. To maintain the compression of the terminals against the pads, the PCBs must be held against the terminals.

Each terminal usually includes a resilient arm portion or elastic beam portion at one end of the terminal, a usually non-elastic portion at the other end, and a pivot between the two ends. When connecting two circuit boards, the connector is mounted between the two circuit boards so that the terminals are compressed between the two circuit boards. The resilient arm portion is deflected as the arm portion pivots about the pivot and is brought into pressure contact with the contact pad of a first of the two circuit boards. The other non-elastic portion is usually soldered to the contact pad of the second circuit board. The circuit boards may be mounted together by various means to maintain the connector terminals in a compressed state, such that the terminals are in pressure contact with the contact pads, allowing the transmission of electrical signals between the circuit boards.

U.S. Pat. No. 4,623,207, issued on 18 Nov. 1986 in the name of Sasaki et al, relates to a PCB connector comprising a plurality of roughly U-shaped terminals longitudinally housed within a connector body by pressure fitting. Each terminal comprises a round base portion, a first resilient arm portion having an elastically bent contact portion for contacting a pad on one of the PCBs, and a second arm portion having a similar elastically bent contact portion for contacting a pad on the other PCB. The resilient arms deflect and pivot about the base portion when the terminals are compressed. The PCBs are mounted such that the terminals are kept in a compressed state by the PCBs.

In certain applications, for example, in small electrical components, very small and low-height connectors are required to connect the printed circuits in the electrical components. For low-height connectors, the compression force required to maintain good contact between the terminals and the contact pads on the PCBs is either unattainable with conventional connectors, or achieved by using more expensive materials or through more complicated terminal designs and consequently incur higher manufacturing or production costs.

Thus, a need exists for an economical low-height connector that can sufficiently meet the compression force requirements.

SUMMARY

According to an aspect of the invention, there is provided a connector. The connector comprises a connector housing and at least one deformable connector terminal arrangement disposed at the connector housing. The or each connector terminal arrangement comprises a terminal and first and second pivot portions. The terminal comprises a movable resilient arm portion, a contact portion at one end of the resilient arm portion for connecting to a first electrical point and a support portion connected to another end of the resilient arm portion and for connecting to a second electrical point. The first pivot portion is for pivoting the resilient arm portion relative to the support portion. The second pivot portion is for pivoting the contact portion relative to the resilient arm portion.

According to a second aspect of the invention, there is provided an assembly comprising a first circuit, a second circuit and an electrical connector for electrically connecting the first circuit to the second circuit. The electrical connector is as defined in the first aspect.

According to yet another aspect, the present invention provides a method of connecting an assembly, which assembly is as defined in the second aspect. The method comprises contacting one or more first and second electrical points of the first and second circuits, respectively, with one or more contact portions and one or more support arm portions of the connector, respectively. The method also comprises moving the first circuit against a biasing force from the one or more contact portions of the connector. Moving the first circuit against a biasing force from the one or more contact portions deflects the resilient arm portion about the first pivot portion during movement of the contact portion in a first direction to a first deflection position, and deflects the contact portion about the second pivot portion during further movement of the contact portion in the first direction beyond the first deflection position.

BRIEF DESCRIPTION OF THE DRAWINGS

Embodiments of the invention are described hereinafter with reference to the accompanying drawings in which.

DETAILED DESCRIPTION

A more complete appreciation of the invention and many of the attendant advantages thereof may be readily obtained by reference to the following detailed description when considered with the accompanying drawings.

Figure 1:
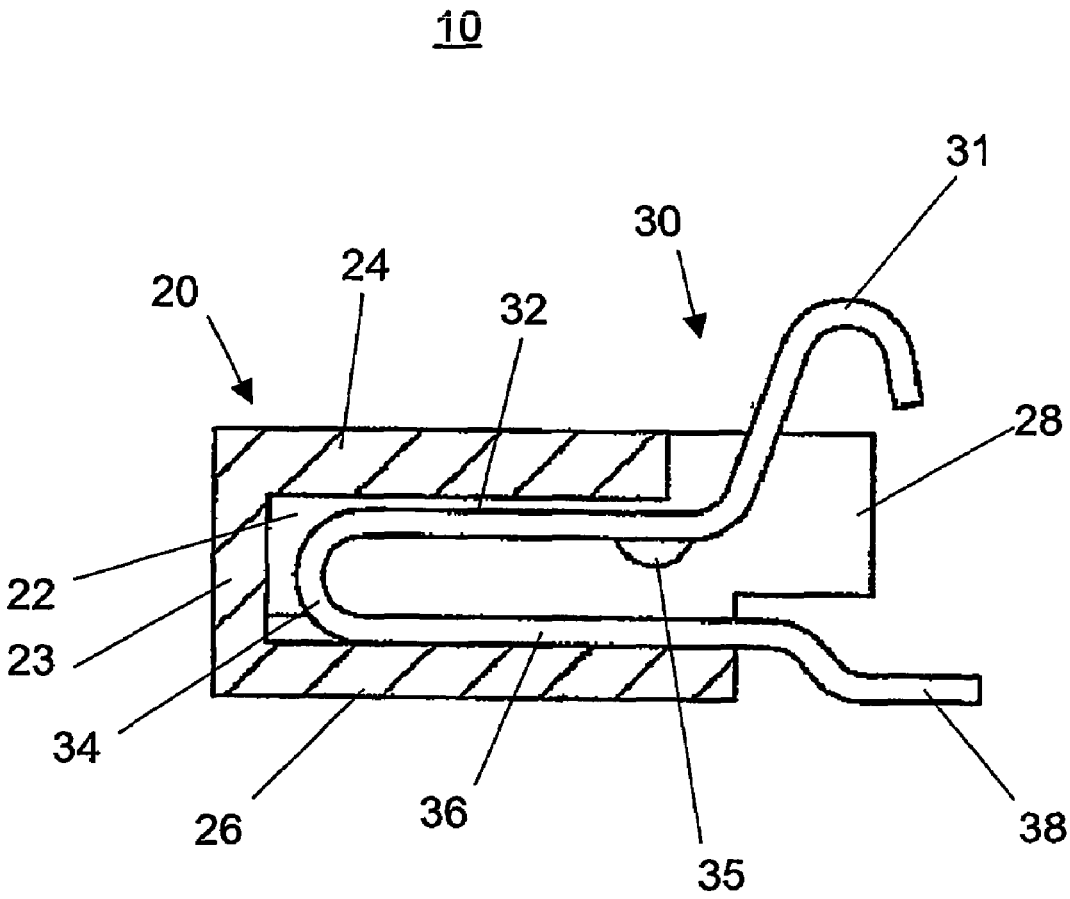
FIG. 1 is a side view of a connector in accordance with an exemplary embodiment of the present invention.
Figure 2:
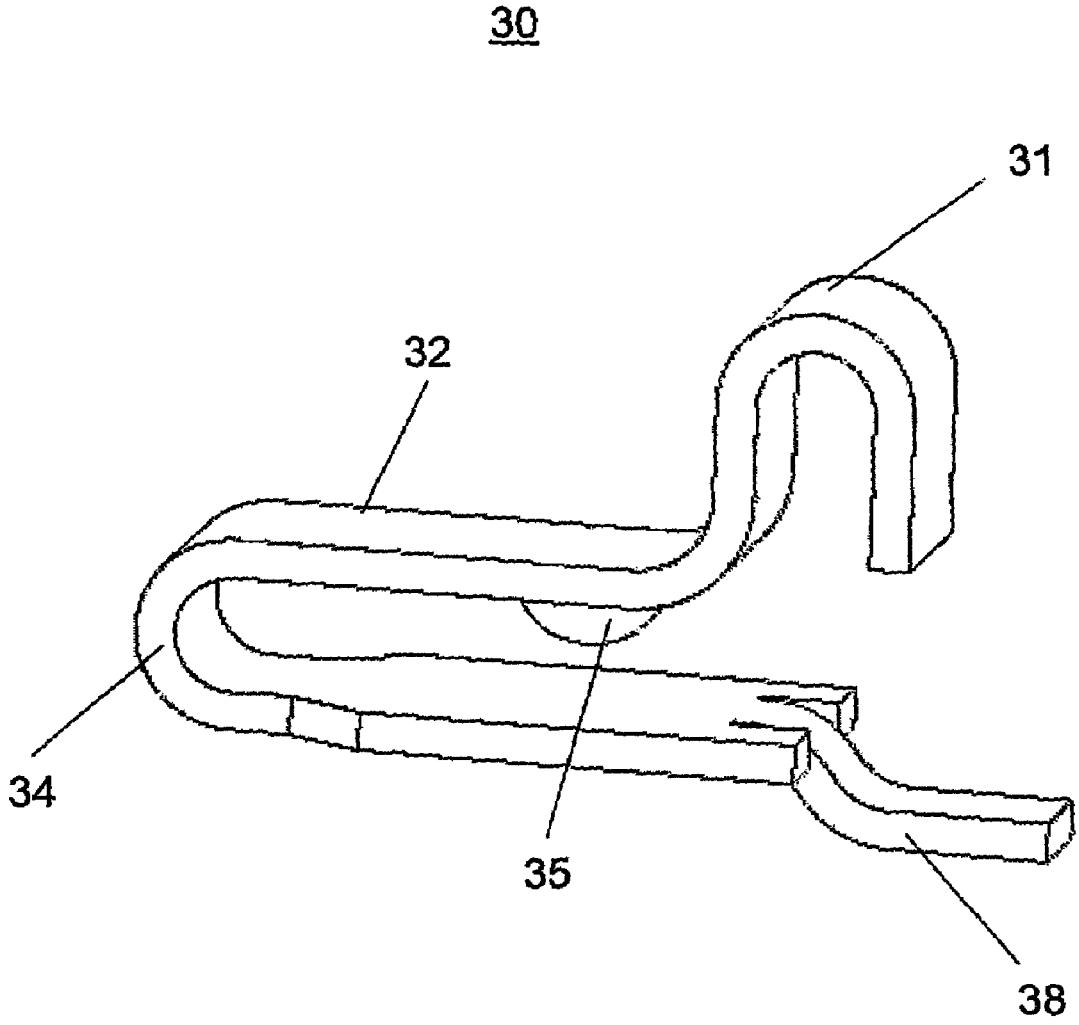
FIG. 2 is an isometric perspective view of a terminal of the connector of FIG. 1.

FIG. 1 shows a diagrammatic side view of a connector 10 in accordance with an exemplary embodiment of the present invention. FIG. 2 shows an isometric perspective view of a terminal 30 of the connector 10 in accordance with the connector 10 shown in FIG. 1. The connector 10 comprises a connector housing 20 and one or more connector terminals 30 arranged within the housing 20. For the purposes of illustration, only one connector terminal 30 is shown in most of the drawings. However, it should be understood that for most applications, there is usually a plurality of terminals 30 arranged within the housing 20.

In this exemplary embodiment, the connector terminal 30 has a resilient arm portion 32, a support portion 36. A first pivot portion 34 is disposed between the resilient arm portion 32 and the support portion 36. The connector terminal 30 is made of an electrically conductive material to allow transmission of electrical signals through the connector terminal 30. The connector terminal 30 may be made of materials such as phosphor bronze, beryllium copper, and may be made by stamping.

The resilient arm portion 32 is generally elongate, having an arched contact portion 31 at one end. The first pivot portion 34 is located at an opposite end of the resilient arm portion 32. The contact portion 31 is in the form of an arched segment at the end of the resilient arm portion 32. The top surface of the arched segment is adapted to contact with a contact pad on a PCB board during assembly. The shape of the contact portion 31 depends on the shape and configuration of contact pads thus, the shape of the contact portion 31 is not limited to the arched segment as described. The arched segment of the contact portion 31 tapers in a slightly slanted orientation connecting the contact portion 31 to the resilient arm portion 32. The resilient arm portion 32 extends in a plane that is generally normal to the tapering of the arched segment. When the connector terminal 30 is arranged in the connector housing 20, the resilient arm portion 32 lies in a horizontal plane that is substantially parallel to the connector housing 20, as shown in FIG. 1. The contact portion 31 lies in a plane above the plane of the resilient arm portion 32. The first pivot portion 34 is generally a resilient connecting portion. In this exemplary embodiment, the first pivot portion 34 is integral to the connector terminal 30. The first pivot portion 34 is in the form of a U-shaped segment of the connector terminal 30 and acts as a point about which the resilient arm portion 32 bends or deflects when a downward force is applied to the contact portion 31 of the resilient arm portion 32, during compression of the connector terminal 30. The opposite end of the resilient arm portion 32 bends to form part of the U-shaped segment. The first pivot portion 34 resiliently resists bending or deflection of the support arm portion 34 when the connector terminal 30 is compressed. The deflection of the resilient portion 32 is described in greater detail hereinafter.

The support portion 36 is elongate having a tail portion 38 at one end. An opposite end of the support portion 36 is bent to form the tail portion 38 such that when the connector terminal 30 is arranged in the connector housing 20, the tail portion lies on a plane that is below the plane of the straight segment of the support portion 36. The shape of the tail portion 38 is adapted to contact a flex circuit contact pad 45 (shown in FIGS. 5A-5D). In this embodiment, the tail portion 38 is in the form a straight strip of material. An opposite end of the support portion 36 bends to form part of the U-shape segment (i.e. the first pivot portion 34) mentioned earlier. Thus, the first pivot portion 34, in the form of a U-shaped segment of the connector terminal 30, connects the resilient arm portion 32 and the support portion 36 such that resilient arm portion 32 is directly above the support portion 36. The support portion 36 is substantially parallel to the resilient arm portion 32.

The connector further comprises a second pivot portion 35 acts as a point about which the resilient arm portion 32 bends or deflects when the resilient arm portion 32 is deflected. The deflection of the resilient arm portion 32 about the second pivot portion is described in further detail hereinafter. The second pivot portion 35 is disposed between the first pivot portion 34 and the contact portion 31. In this embodiment, the second pivot portion 35 is integral to the resilient arm portion 32 and is located near the segment of the resilient arm portion 32 where the arched contact portion 31 tapers to form the straight segment of the resilient arm portion 32. The second pivot portion 35 is in the form of a protuberance protruding from the surface of the straight segment of the resilient arm portion 32, into the space between the resilient arm portion 32 and the support portion 36. Thus, when the resilient arm portion 32 is deflected, the second pivot portion 35 urges against the support portion 36. In this embodiment, the protuberance is formed as a dimple on the surface of the resilient arm portion 32, as shown in FIG. 2.

The connector housing 20 is a generally rectangular block with a plurality of cavities 22. Each cavity 22 houses a connector terminal 30. The connector housing 20 is made from an insulating material for example, engineering plastics. When viewed from the side, the connector housing 20 has a generally rectangular cross-section (shown as hatched portions in FIG. 1). The connector housing 20 comprises three walls, namely a roof portion or top wall 24, a back wall 23 and a bottom wall 26. The top wall 24 and the bottom wall 26 lie in a horizontal plane and are substantially parallel to each other. The back wall 23 lies in a vertical plane joining the top wall 24 to the bottom wall 26. Thus, the cavity is flanked by the top, back and bottom walls 24, 23, 26. The connector terminal 30 is arranged longitudinally into the cavity 22 in the connector housing 20 such that the top wall 24 of the connector housing 20 is directly above the resilient arm portion 32 and the support portion 36 lies on an inner surface of the bottom wall 26 of the connector housing 20. The U-shaped segment (i.e. the first pivot portion 35) of the connector terminal 30 is close to the back wall 23 of the connector housing 20. The contact portion 31 of the resilient arm portion 32 and the tail portion 38 extend outwardly from the cavity 22 of the connector housing 20. Further, the contact portion 31 lies in a plane above the plane of the top wall 24 of the connector housing 20. The support member 36 is bent downwards to accommodate that thickness of the bottom wall 26 to allow the tail portion 38 to lie in the same plane as an outer surface of the bottom wall 26. The bottom wall 26 of the connector housing 20 has a mounting pin 29 for mounting the connector housing 20 to a casting 60 (shown in FIGS. 5A to 5D).

Figure 3:
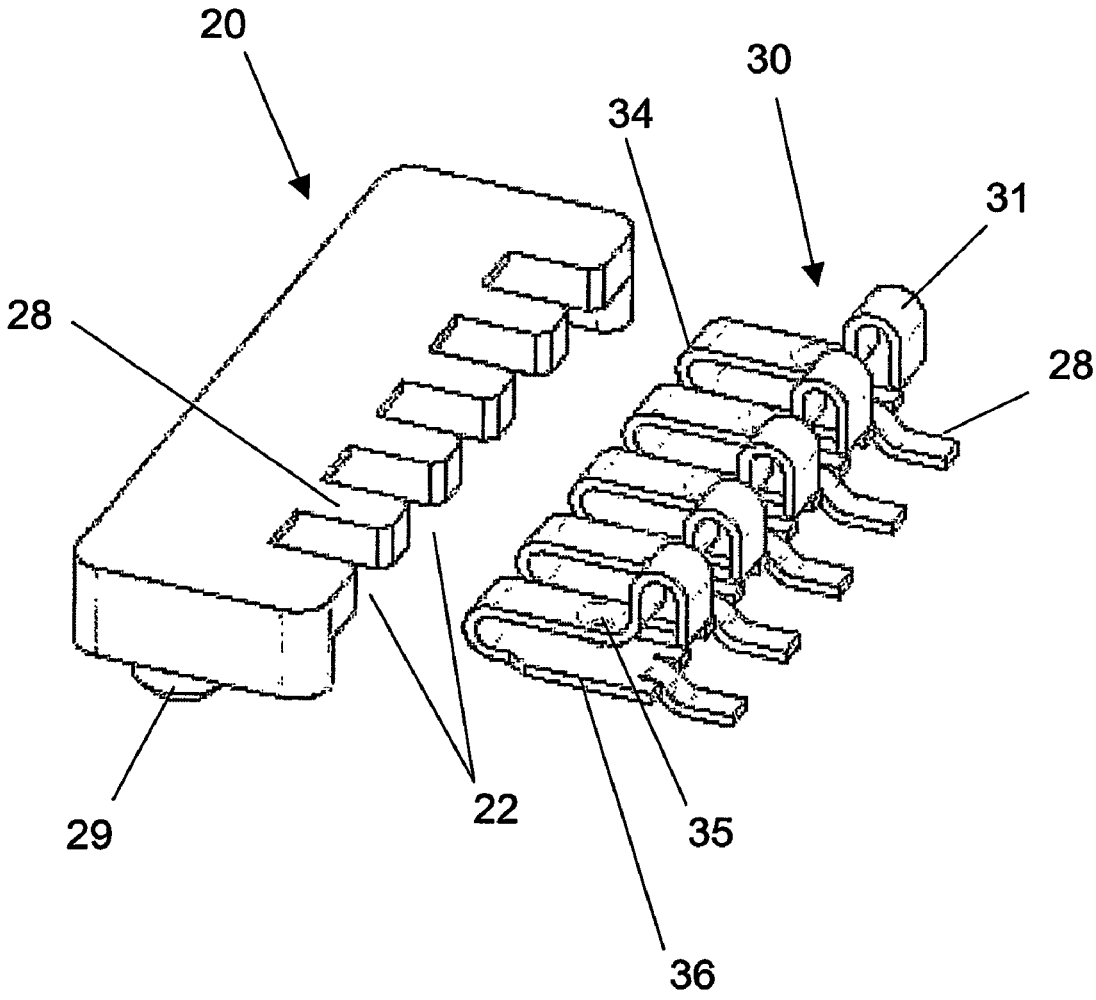
FIG. 3 is an exploded view of the connector of FIG. 1, with a plurality of terminals and a connector housing before assembly together.
Figure 4:
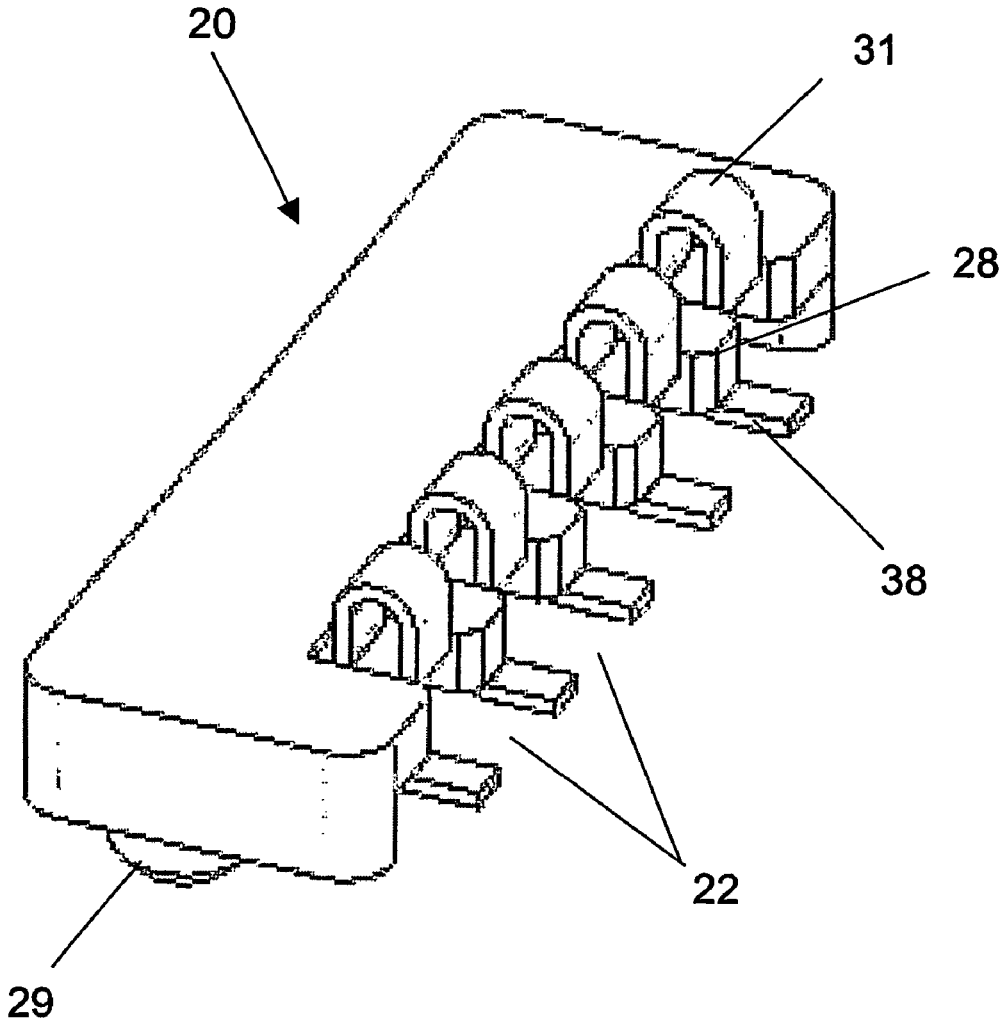
FIG. 4 is an isometric view of the connector of FIG. 1, with the terminals assembled into the connector housing.

As shown in FIG. 3 each cavity 22 is separated from an adjacent cavity by a separating wall 28 that is integral to the connector housing 20. The separating wall 28 is a generally rectangular strip that extends horizontally from the back wall 23 and protrudes beyond the length of the top wall 24 and the bottom wall 26. This results in the connector housing 20 having a comb-shaped profile on one side, as shown in FIGS. 3 and 4. The separating wall 28 is to ensure that each connector terminal 30 is insulated from an adjacent connector terminal(s) 30 in case of any lateral movement of the connector terminals 30.

FIG. 4 shows an isometric perspective view of the connector 10 with a plurality of connector terminals 30 mounted within the connector housing 20. The separating wall 28 extends between each of the contact portions 31 of the connector terminals 30. The connector terminals 30 may be force fitted into the cavities 22 of the housing 20. The connector terminals 30 may be mounted to the housing by various methods such as press-fitting, using latch feature, and by over-molding the terminals into the housing.

FIGS. 5A to 5D are a series of drawings showing how the connector terminals 30 are compressed during assembly of a PCB 50 in accordance with the exemplary embodiment in FIG. 1, when viewed from the side. In this embodiment, the connector 10 is used to electrically connect the PCB 50 to the flex circuit 40. However, both circuits may be PCBs or a combination of various types of printed circuits depending on the requirements of the application. Further, the flex circuit 40 and the PCB 50 may each include a plurality of electrical points in the form of contact pads 45, 55 throughout its entire surface. However, for the purpose of illustration, only one contact pad is shown on both the flex circuit 40 and the PCB 50.

Figure 5A:
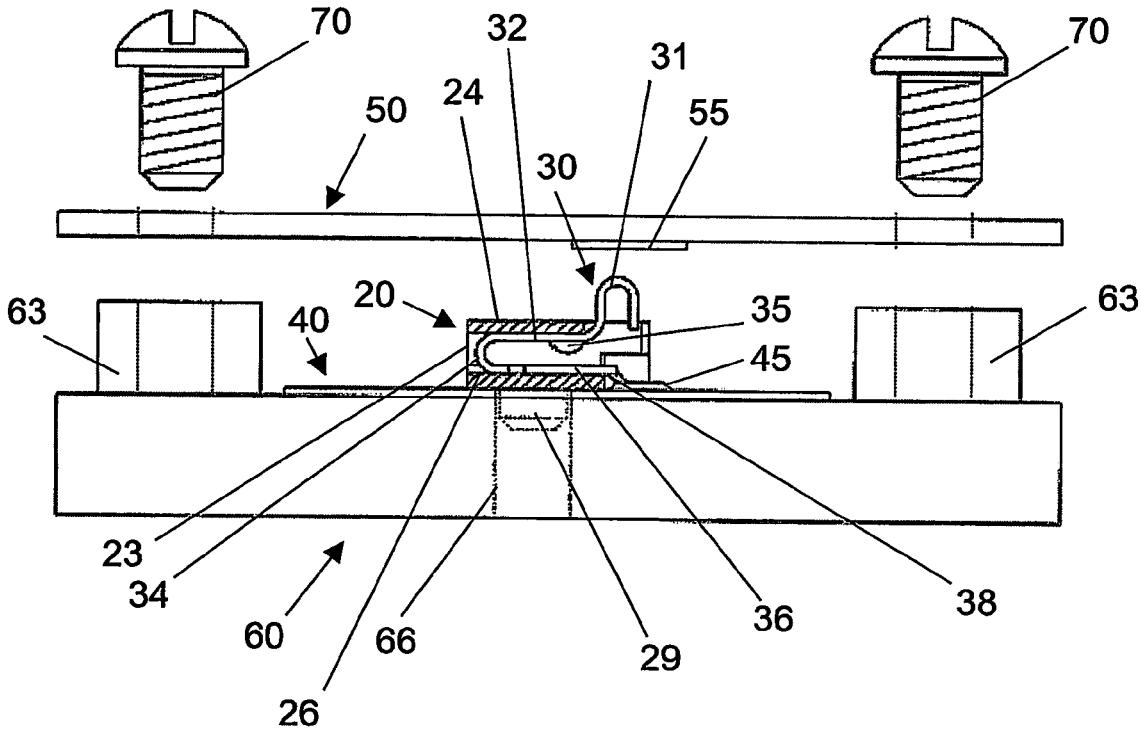
FIG. 5A is a side view of the connector of FIG. 1, with one end of the connector terminal assembled to a flex circuit, at the beginning of the compression stroke.

FIG. 5A shows a connector-PCB assembly 500 of the connector 10 shown in FIG. 1, before the PCB 50 is mounted. Prior to mounting the PCB 50, the flex circuit 40 is first mounted onto a casting 60. The casting 60 provides support for the flex circuit 40 and has an internally threaded boss 63 at each end for mounting the PCB 50. The connector 10 is mounted on top of the flex circuit 40 and onto the casting 60 by fitting the mounting pin 29 protruding from the base portion 26 of the connector housing 20, into a bore 66 that extends from the flex circuit 40 to the casting 60. When the connector 10 is mounted, the tail portion 38 of the terminals 30 comes into contact and aligns with the flex circuit contact pad 45. The shape and size of the tail portion 38 depends on the shape of the flex circuit contact pad 45 and are not limited to the configuration depicted in FIGS. 5A-5D. Upon mounting the connector 10 to the flex circuit 40 and casting 60, the tail portion 38 of the connector terminal 30 is soldered onto the flex circuit contact pads 45.

Figure 5B:
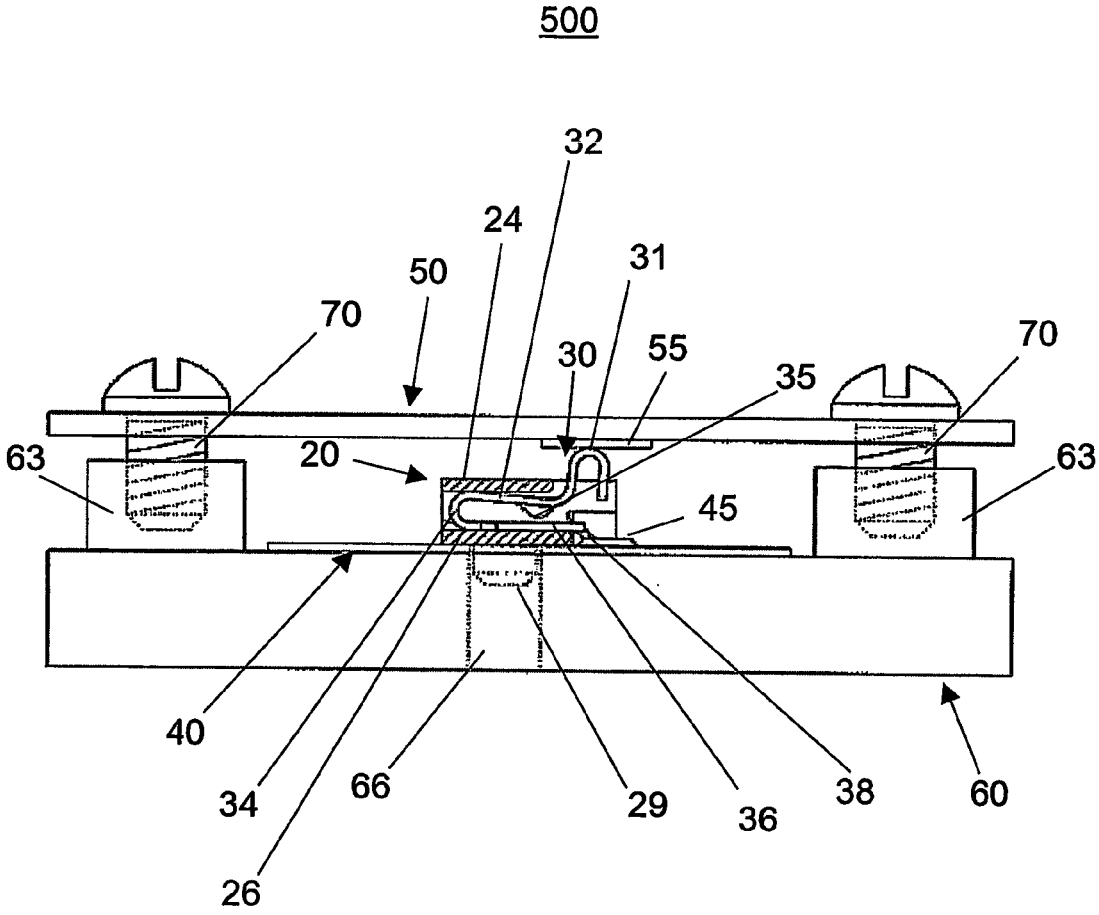
FIG. 5B is a side view of the connector of FIG. 1, at the beginning of a compression stroke, where the terminal pivots about a first pivot portion.

The PCB 50 is mounted on the casting 60 using screws 70 which are inserted through a hole at each end of the PCB 50 and into each of the threaded boss 63 on the casting 60, as shown in FIG. 5B. It should be ensured that when the PCB 50 is mounted onto the casting 60, the PCB contact pad 55 is aligned with the contact portion 31 of the connector terminal 30, such that the contact portion 31 comes into contact with the PCB contact pad 55. As the PCB contact pad 55 comes into contact with the contact portion 31 of the terminal 30, the resilient arm portion 32 begins to bend or deflect downwards from its initial position and pivots about the first pivot portion 34. This marks the beginning of a compression stroke of the connector terminal 30. The first pivot portion 34 acts as a primary pivot about which the resilient arm portion 32 bends or deflects. As the screws 70 are tightened, the PCB 50 is moved closer towards the flex circuit 40 and the casting 60. As a result, the resilient arm portion 32 is deflected towards the support portion 36 of the connector terminal 30 as the PCB board contact pad 55 presses against the contact portion 31 of resilient arm portion 32. A contact pressure corresponding to the resistance to deflection of the resilient arm portion 32 is produced at the PCB contact pad 55. In other words, as the PCB contact pad 55 is pressed against the contact portion 31 of the resilient arm portion 32, the resilient arm portion 32 in turn exerts a reaction force on the PCB contact pad 55. For a low-height connector (i.e. the space between the resilient arm portion 32 and the support portion 36 is small), this deflection may not be sufficient to produce the required contact pressure on a contact pad of a PCB to ensure and maintain good contact between the contact portion 31 of the terminal 30 and the PCB contact pad 55.

Figure 5C:
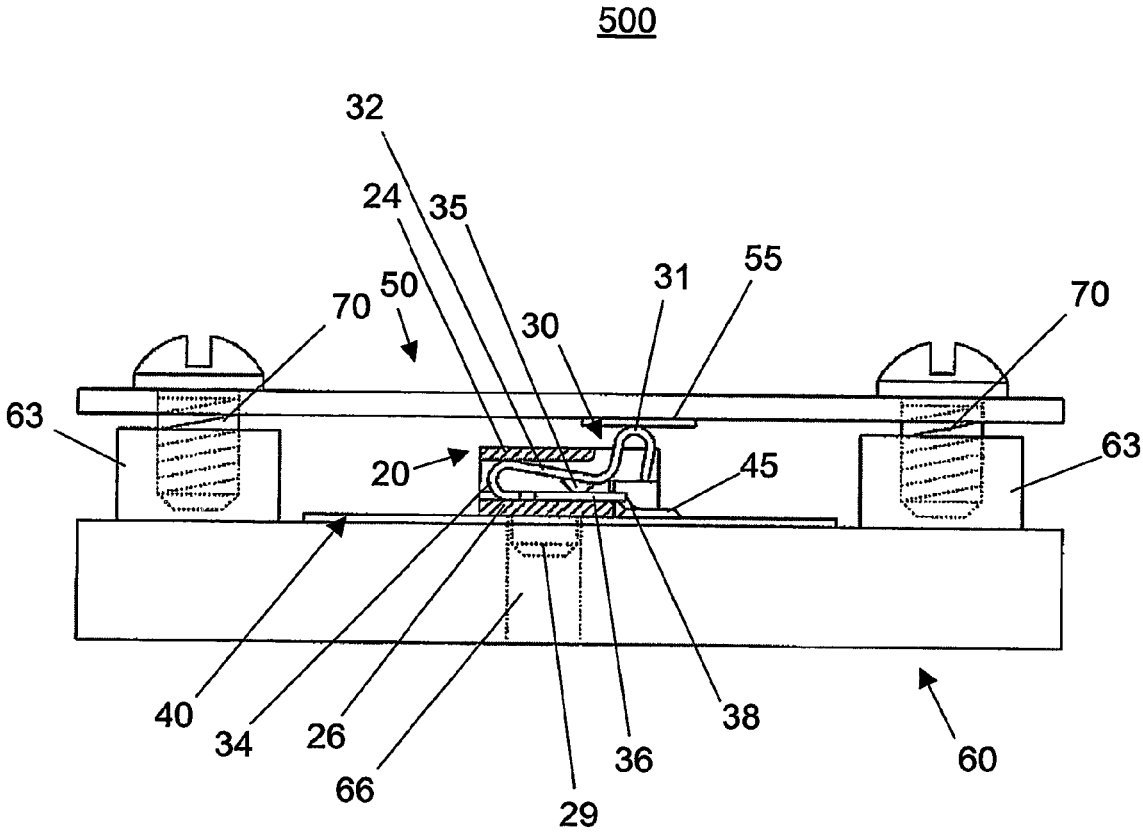
FIG. 5C is a side view of the connector of FIG. 1 near the end of the compression stroke, where the terminal pivots about a second pivot portion.

As the screws 70 are inserted further into the boss 63, the resilient arm portion 32 is deflected further until the second pivot portion 35 (i.e. the protuberance) urges against the support portion 36 of the connector terminal 30, as shown in FIG. 5C. The second pivot portion 35 acts as a secondary pivot about which the resilient arm portion 32 bends or deflects. When the second pivot portion 35 pivots against the support portion 36 of the terminal 30, the effective beam length (perpendicular distance between the pivot and the applied force) of the resilient arm portion 32 is shortened. As a result, the reaction force at the contact portion 31 of the terminal 30 is increased. This allows the required contact force on PCB contact pad 55 to be met, and good contact between the contact portion 32 of the terminal 30 and the PCB contact pad 55 is maintained.

The second pivot portion 35 may be disposed at any position between the first pivot portion 34 and the contact portion 31 of the terminal 30 in order for the second pivot portion 35 to act as a secondary pivot. In this embodiment, the second pivot portion 35 is located on the resilient arm portion 32, near the transition between the resilient arm portion 32 and the arched contact portion 31. The position of the second pivot portion 35 may be adjusted such that secondary pivoting of the resilient arm portion 32 happens near the end of the compression stroke. This is to prevent the resilient arm portion 32 from being over-stressed during compression of the connector terminal 30.

Figure 5D:
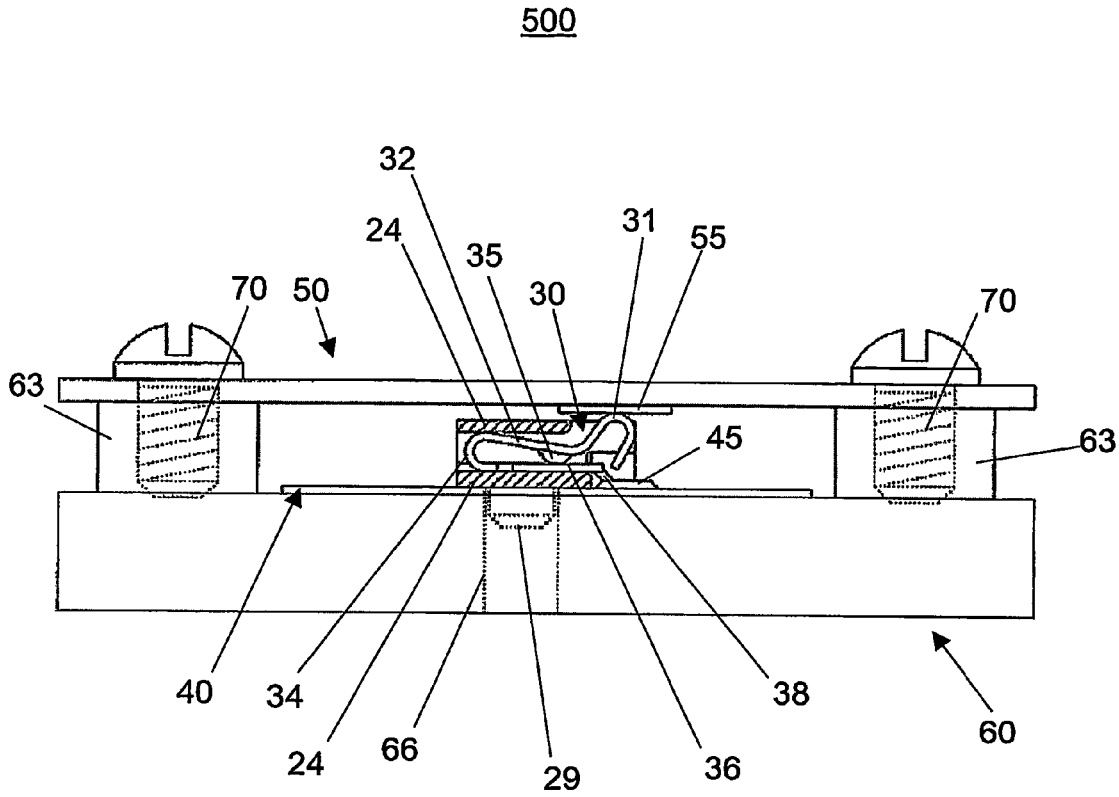
FIG. 5D is side view of the connector of FIG. 1 assembled between the flex circuit and PCB, at the end of the compression stroke.

FIG. 5D shows the PCB 50 when the PCB 50 is fully assembled to the casting 60. The connector terminal 30 is now sufficiently compressed between the PCB 50 and the flex circuit 40. The screws 70 are fully tightened. This marks the end of the compression stroke.

FIGS. 6 to 9 show a connector in accordance with further embodiments of the present invention. Similar terms (although reference numerals differ) are used for corresponding parts of the connector in the different embodiments.

Figure 6:
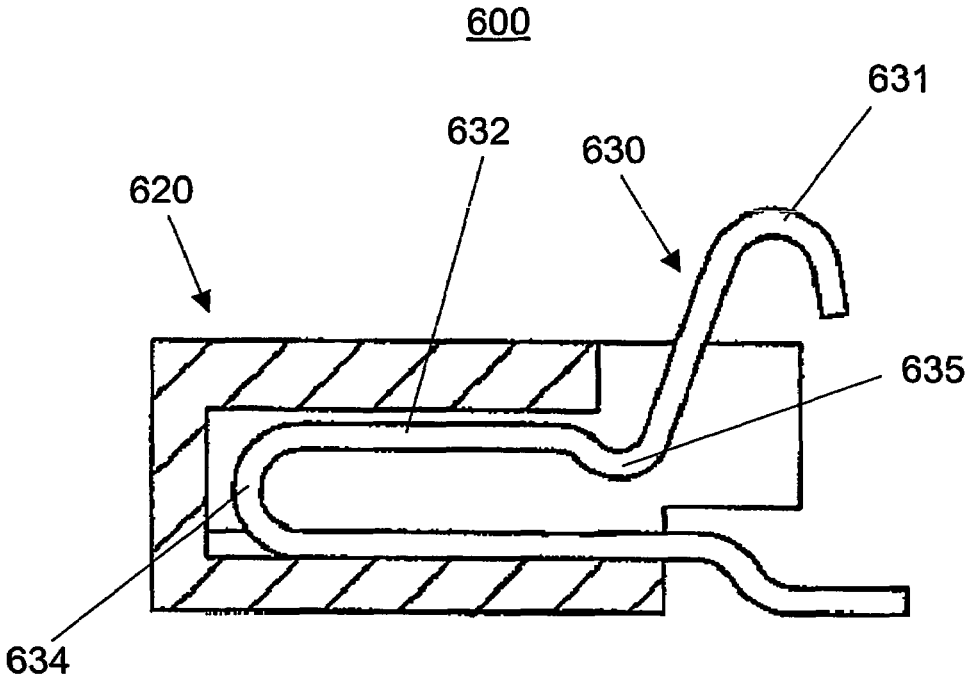
FIG. 6 is a side view of a connector in accordance with another embodiment of the present invention.

FIG. 6 shows a connector 600 in accordance with another embodiment of the present invention, when viewed from the side. The connector 600 comprises a housing 620 and a connector terminal 630. The connector housing 620 in this embodiment is the same as the connector housing 20 in FIG. 1. In this embodiment, the connector terminal comprises an elongate resilient arm member 632 having a first pivot portion 634 at one end and a contact portion 631 at an opposite end. A second pivot portion 635 disposed between the first pivot portion 634 and the contact portion 631, is in the form of an arcuate portion instead of the dimple 35 shown in FIG. 1.

Figure 7:
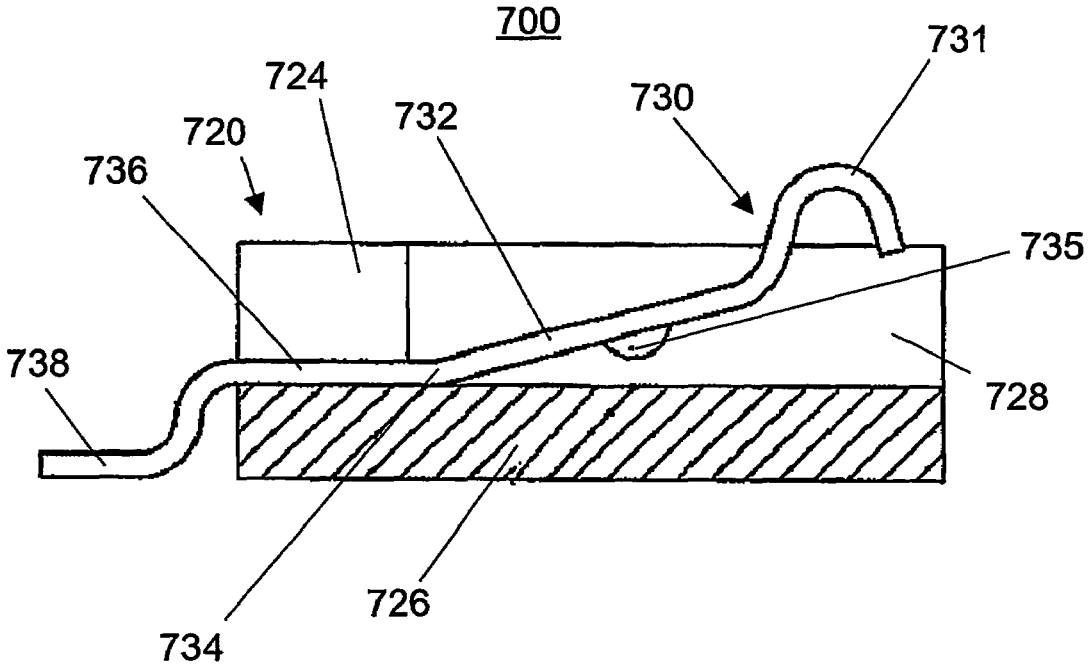
FIG. 7 is a side view of a connector in accordance with yet another embodiment of the present invention.

FIG. 7 shows a connector 700 in accordance with yet another embodiment of the present invention, when viewed from the side. The connector 700 comprises a connector housing 720 and a connector terminal 730 arranged in the housing 720. In this embodiment, the connector terminal 730 is generally elongate. The connector terminal 730 comprises a resilient arm portion 732, a first pivot portion 734, a second pivot portion 735 and a support portion 736. The resilient arm portion 732 has an arched contact portion 731. The first pivot portion 734 is disposed between the resilient arm portion 734 and the support arm portion 736. The first pivot portion 734 is in the form of a sharp bend instead of the U-shaped segment as shown in FIG. 1. The second pivot portion 735 is integral to the resilient arm portion 732 and is disposed between the first pivot portion 734 and the contact portion 731. The second pivot portion 735 is in the form of a dimple.

The support portion 736 extends horizontally from the first pivot portion 734. The resilient arm portion 732 is disposed at an angle with respect to the support portion. This allows the resilient arm portion 732 to deflect when the connector terminal 730 is compressed. Thus, the connector 700 has a generally elongate side profile having the contact portion 731 at one end and a tail portion 738 at an opposite end.

In this embodiment, the connector housing 720 has a plurality of cavities 723 along its length. Each connector terminal 730 is housed within each cavity 723. Each cavity 723 is separated from an adjacent cavity by a separating wall 728, as shown in FIG. 7. Each cavity 723 is defined by a base portion 726, a top portion 724 extending substantially perpendicular to the base portion 726. The top portion 724 extends partially along the width of the base portion 726, giving rise to an L-shaped cross-section depicted as hatched regions in FIG. 7. The support portion 736 of the connector terminal 730 is disposed between the top portion 724 and bottom portion 736 of the connector housing 720.

When the connector terminal 730 is mounted to the connector housing 720, the tail portion 738 extends away from the connector housing 720. The resilient arm portion 732 extends within the cavity, at an angle with respect to the base portion 726 of the connector housing 720. The resilient arm portion 732 of the connector terminal 730 slants upwards such that there is sufficient clearance between the resilient arm portion 732 and the base portion 726 to allow the resilient arm portion 732 to deflect when the connector terminal 730 is compressed. During secondary pivoting, the second pivot portion 735 urges against the base portion 726 of the connector housing 720.

Figure 8:
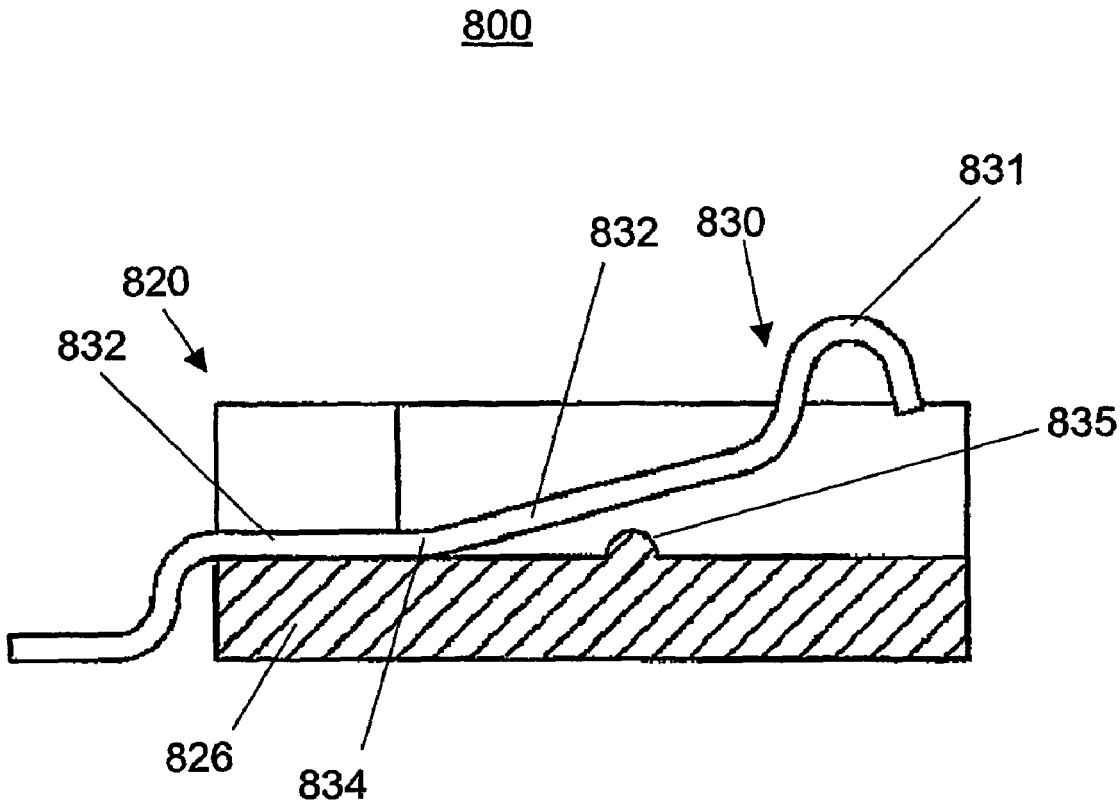
FIG. 8 is a side view of a connector in accordance with an embodiment of the present invention.

FIG. 8 shows a connector 800 in accordance with another embodiment of the present invention, when viewed from the side. The connector 800 in this embodiment is similar to the connector 700 shown in FIG. 7. The connector 800 comprises a connector housing 820 and a connector terminal 830. The shape and configuration of the connector housing 820 and the connector terminal 830 in this embodiment are similar to the connector 700 shown in FIG. 7. In this embodiment, a second pivot portion 835 is located on a base portion 826 of the connector housing 800. The second pivot portion is in the form of a dimple. The second pivot portion 835 is located at a position such that the second pivot portion 835 comes into contact with a resilient arm portion 832 at a position between a first pivot portion 834 and a contact portion 831 of the connector terminal 800 when the resilient arm portion 832 is deflected.

Figure 9:
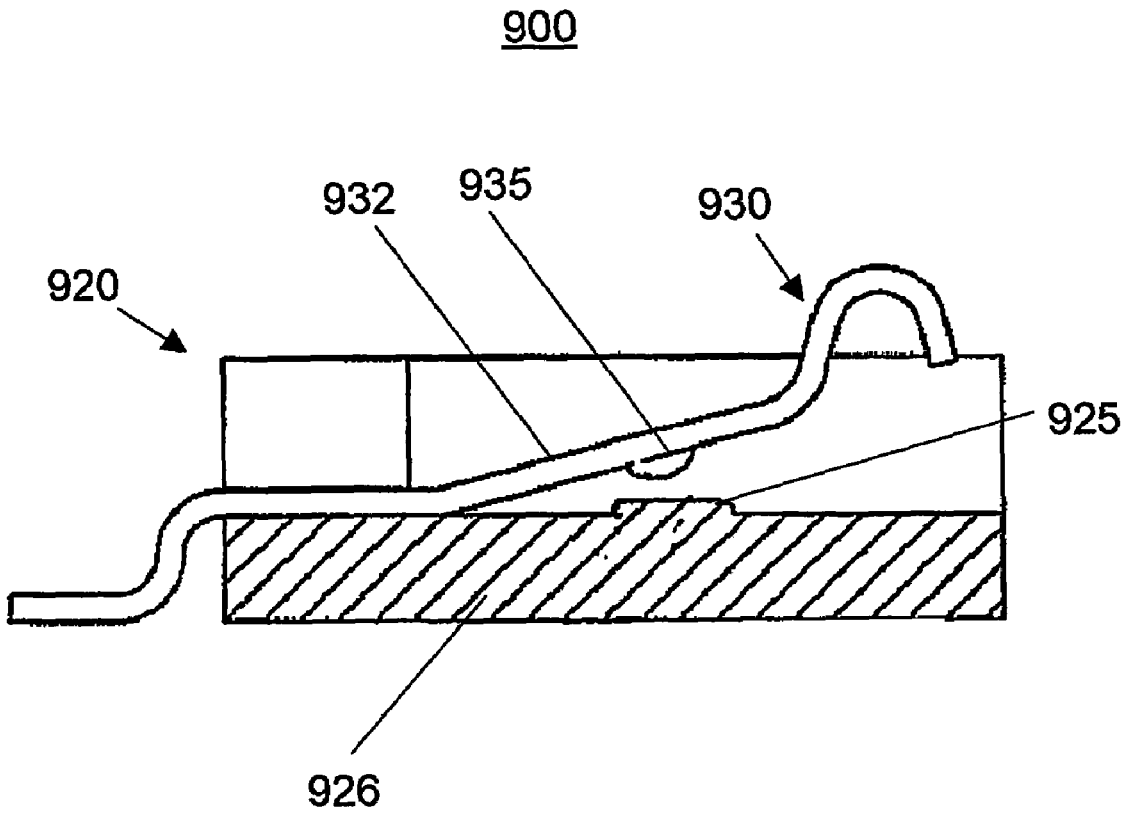
FIG. 9 is a side view of a connector in accordance with another embodiment of the present invention.

FIG. 9 shows a connector 900 in accordance with another embodiment of the present invention. The connector 900 comprises a connector housing 920 and a connector terminal 930. The connector terminal 930 in this embodiment is equivalent to the connector terminal 730 shown in FIG. 7. The connector terminal 930 comprises a second pivot portion 935 in the form of a dimple protruding from a resilient arm portion 932 of the connector terminal 930. In this embodiment, a raised portion 925 having a flat surface is disposed on a base portion 926 of the connector housing 920. The raised portion 925 is disposed directly under the second pivot portion 935. When the resilient arm 932 is deflected, the second pivot portion 935 urges against the raised portion 925 protruding from the base portion 926. The second pivot portion 935 and the raised portion 925 act as a secondary pivot portion when the resilient arm portion 932 is deflected.

Although the invention has been described with reference to specific examples, it will be appreciated by those skilled in the art that the invention may be embodied in many other forms.

The invention claimed is:

1. An electrical connector comprising:

a connector housing; and at least one deformable connector terminal arrangement disposed at the connector housing, the or each connector terminal arrangement comprising:

a terminal comprising a movable resilient arm portion, a contact portion at one end of the resilient arm portion for connecting to a first electrical point and a support portion connected to another end of the resilient arm portion and for connecting to a second electrical point, wherein the support portion is seated in the connector housing, and wherein the terminal further comprises a contact tail portion extending from the support portion out of the housing;

a first pivot portion for pivoting of the resilient arm portion relative to the support portion; and a second pivot portion for pivoting of the contact portion relative to the resilient arm portion, wherein the resilient arm portion is located directly opposite a base portion of the connector housing, and when the contact portion is pressed down towards the base portion, the resilient arm portion is configured to move towards the base portion and contact the base portion at the second pivot portion.

2. A connector according to claim 1, wherein the resilient arm portion is operable to deflect about the first pivot portion during movement of the contact portion in a first direction up to a first deflection position, and the contact portion is operable to deflect about the second pivot portion during further movement of the contact portion in the first direction beyond the first deflection position.

3. A connector according to claim 1, wherein the first pivot portion connects the resilient arm portion to the support portion, the first pivot portion resiliently resists deflection of the resilient arm portion if a force is applied to the contact portion.

4. A connector according to claim 1, wherein the resilient arm portion and the support portion are elongate.

5. A connector according to claim 1, wherein the contact portion comprises a bent segment having an arched portion for contacting the first electrical point.

6. A connector according to claim 1, wherein the second pivot portion is disposed on the housing.

7. A connector according to claim 1, wherein the resilient arm portion is disposed at an angle with respect to the support portion.

8. A connector according to claim 1, wherein the connector terminal is formed of an electrically conductive material.

9. A connector according to claim 1, wherein the terminal is elongate, with the contact portion at an opposite end from the support portion.

10. A connector according to claim 1, wherein the contact portion comprises a second free end of the terminal.

11. A connector according to claim 1, wherein the housing further comprises a mounting pin for mounting the housing in an assembly.

12. A connector according to claim 1, wherein the terminal further comprises the first pivot portion, disposed between the resilient arm portion and the support portion.

13. A connector according to claim 12, wherein the first pivot portion is formed integrally with the resilient arm portion and the support portion.

14. A connector according to claim 12, wherein the first pivot portion comprises a resilient connecting portion connecting the resilient arm portion and the support portion.

15. A connector according to claim 12, wherein the first pivot portion comprises a bend joining the resilient arm portion and the support portion.

16. A connector according to claim 1, wherein the second pivot portion comprises a protuberance disposed on at least one of the terminal and the housing.

17. A connector according to claim 16, wherein the or each protuberance of a terminal arrangement has a rounded surface.

18. A connector according to claim 16, wherein the or each protuberance of a terminal arrangement has a flat surface.

19. A connector according to claim 16, wherein the or each protuberance of a terminal arrangement is solid.

20. A connector according to claim 16, wherein the or each protuberance of a terminal arrangement is hollow.

21. A connector according to claim 1, wherein the terminal further comprises the second pivot portion, disposed between the resilient arm portion and the contact portion.

22. A connector according to claim 21, wherein the second pivot portion is formed integrally with the resilient arm portion.

23. A connector according to claim 21, wherein the second pivot portion comprises a bent portion of the resilient arm portion.

24. A connector according to claim 23, wherein the bent portion is arcuate.

25. A connector according to claim 1, wherein the connector housing comprises one or more cavities, with individual ones of the connector terminal arrangements arranged in individual ones of the cavities.

26. A connector according to claim 25, further comprising separating walls between adjacent cavities.

27. A connector according to claim 25, wherein individual cavities are defined by a roof portion spaced apart from a base portion, with the resilient arm portion and the support portion of a connector terminal arrangement disposed within the cavity.

28. A connector according to claim 1, wherein the tail portion extending from a free end of the support arm portion, to contact the second electrical point.

29. A connector according to claim 28 wherein the connector housing comprises one or more cavities, with individual ones of the connector terminal arrangements arranged in individual ones of the cavities, wherein the contact portions and the tail portions of the terminal protrude from individual cavities.

30. A connector according to claim 28, wherein the tail portion comprises a first free end of the terminal.

31. An assembly comprising:

a first circuit;

a second circuit; and an electrical connector as in claim 1 electrically connecting the first circuit to the second circuit.

32. An assembly according to claim 31, wherein the first circuit is a printed circuit board.

33. An assembly according to claim 31, wherein the second circuit is a flex circuit.

34. An assembly according to claim 31, wherein:

the connector is mounted to connect the first and second circuits electrically;

the first circuit comprises one or more first electrical points with which the one or more contact portions are in contact; and the second circuit comprises one or more second electrical points with which the one or more support portions are in contact.

35. An assembly according to claim 34, wherein the one or more resilient arm portions are pivoted about the respective first pivot portions; and the one or more contact portions are pivoted about the respective second pivot portions.

36. A method of connecting an assembly, which assembly is as defined in claim 31, the method comprising:

contacting one or more first electrical points of the first circuit with one or more contact portions of the connector;

contacting one or more second electrical points of the second circuit with one or more support arm portions of the connector;

moving the first circuit against a biasing force from the one or more contact portions of the connector, deflecting the resilient arm portion about the first pivot portion during movement of the contact portion in a first direction to a first deflection position, and deflecting the contact portion about the second pivot portion during further movement of the contact portion in the first direction beyond the first deflection position.

37. A method according to claim 36, further comprising mounting the connector to the second circuit prior moving the first circuit against the biasing force.

38. A method according to claim 36, wherein moving the first circuit against the biasing force is achieved by screwing the first circuit down.

39. A method according to claim 36, further comprising mounting the first circuit to the connector.

40. A method according to claim 39, wherein mounting the first circuit to the connector comprises moving the first circuit against the biasing force.

41. An electrical connector comprising:

a connector housing; and at least one deformable connector terminal arrangement disposed at the connector housing, the or each connector terminal arrangement comprising:

a terminal comprising a movable resilient arm portion, a contact portion at one end of the resilient arm portion for connecting to a first electrical point and a support portion connected to another end of the resilient arm portion and for connecting to a second electrical point;

a first pivot portion for pivoting of the resilient arm portion relative to the support portion; and a second pivot portion for pivoting of the contact portion relative to the resilient arm portion, wherein the connector housing is formed of an electrically insulating material, wherein the resilient arm portion is located directly opposite a base portion of the connector housing, and when the contact portion is pressed down towards the base portion, the resilient arm portion is configured to move towards the base portion and contact the base portion at the second pivot portion.

* * * * *